US008550517B1

(12) United States Patent
Bates

(10) Patent No.: US 8,550,517 B1
(45) Date of Patent: Oct. 8, 2013

(54) TELESCOPIC BARREL LIFTING ATTACHMENT DEVICE

(76) Inventor: Albert Richard Bates, Fruita, CO (US)

( * ) Notice: Subject to any disclaimer, the term of this patent is extended or adjusted under 35 U.S.C. 154(b) by 231 days.

(21) Appl. No.: 13/222,204

(22) Filed: Aug. 31, 2011

Related U.S. Application Data

(60) Provisional application No. 61/379,676, filed on Sep. 2, 2010.

(51) Int. Cl.
*B66C 1/44* (2006.01)
*B66C 1/66* (2006.01)

(52) U.S. Cl.
USPC .... 294/67.33; 294/81.21; 294/90; 294/119.1; 414/626

(58) Field of Classification Search
USPC ..... 294/67.33, 81.21, 81.62, 90
See application file for complete search history.

(56) References Cited

U.S. PATENT DOCUMENTS

| | | | | | |
|---|---|---|---|---|---|
| 859,825 | A * | 7/1907 | Mann | 294/67.33 |
| 1,819,390 | A * | 8/1931 | Seager | 294/67.33 |
| 2,377,845 | A * | 6/1945 | Westfall | 294/87.1 |
| 2,789,858 | A * | 4/1957 | Kughler | 294/67.33 |
| 3,352,591 | A * | 11/1967 | Casey | 294/106 |
| 3,915,488 | A * | 10/1975 | Anderson | 294/90 |
| 4,951,990 | A * | 8/1990 | Hollan et al. | 294/119.1 |
| 5,344,207 | A * | 9/1994 | Grimm | 294/103.1 |
| 5,441,322 | A * | 8/1995 | Jobmann et al. | 294/90 |
| 6,371,543 | B1 * | 4/2002 | Fujikawa et al. | 294/82.13 |
| 6,749,392 | B1 * | 6/2004 | Adams et al. | 414/800 |
| 7,222,903 | B2 * | 5/2007 | Tardiff | 294/81.21 |
| 8,317,243 | B2 * | 11/2012 | Emond et al. | 294/67.33 |

* cited by examiner

*Primary Examiner* — James Keenan

(57) ABSTRACT

A telescopic barrel lifting attachment device which includes a parallelepiped body, a plate member disposed perpendicularly thereto on each end of the body, a pair of slide bars disposed on each side of the body having a channel therebetween through which the body slides, a concave clamp assembly disposed on a bottom end of each plate member, and a cable having external ends attached to the plate members. As the cable is raised and alternately is lowered by a hoist, the cable pulls the clamp assemblies inwardly toward and alternately allows the clamp assemblies to move away from each other to secure and move and alternately release a barrel in a desired location.

4 Claims, 4 Drawing Sheets

TELESCOPIC BARREL LIFTING ATTACHMENT DEVICE

CROSS-REFERENCE TO RELATED APPLICATIONS

U.S. Provisional Patent Application No. 61/379,676 filed Sep. 2, 2010

BACKGROUND OF THE INVENTION

Various types of 55-gallon barrel handling devices are known in the prior art. However, what is needed is a telescopic barrel lifting attachment device which includes a parallelepiped body, a pair of slide bars disposed on each side of the body attached together with a pair of retainer bars, the slide bars separated by a channel through which the body slides, a plate member on each end of the body to which each end of the cable is attached, a concave clamp assembly attached to a bottom side each plate member that conforms to a rim of a 55-gallon barrel to lift and move the barrel to a desired location. As the cable is raised and alternately is lowered, the cable pulls the clamp assemblies inwardly toward and alternately allows the clamp assemblies to move away from each other to secure and move and alternately release a barrel in a desired location.

FIELD OF THE INVENTION

The present invention relates to barrel handling devices, and more particularly, to a telescopic barrel lifting attachment device.

SUMMARY OF THE INVENTION

The general purpose of the present telescopic barrel lifting attachment device, described subsequently in greater detail, is to provide a telescopic barrel lifting attachment device which has many novel features that result in a telescopic barrel lifting attachment device which is not anticipated, rendered obvious, suggested, or even implied by prior art, either alone or in combination thereof.

To accomplish this, the present telescopic barrel lifting attachment device is a lifting device used in conjunction with a hoist to lift a standard 55-gallon barrel to move the barrel to a desired location. The device securely clamps two opposing edges under the rim of the barrel. The device presses in on both edges during the actual lifting operation to easily and securely move the barrel without any danger of the barrel falling to the ground or floor. The present device includes a telescopic lifting beam and two rounded clamp assemblies. The lifting beam has a substantially parallelepiped body having a parallelepiped plate member extended downwardly at each end. One of the plate members has a parallelepiped bar attached thereto in a position parallel to the lifting beam and a continuous channel disposed between the bar and the lifting beam. A pair of substantially slide bars slidingly engages the bar and the lifting beam whereby the lifting beam extends and retracts. An elongated slightly concave clamp assembly attached to an upper inside edge of each of the plate members. A semi-circular support plate, having an internal edge and an upper side, is disposed on an outer side of each clamp assembly. The internal edge of each support plate is permanently attached to the outer side of the clamp assembly while the upper side of the support plate is permanently attached to a bottom side of the plate member. The external ends of a steel cable removably attach to an aperture is disposed proximal to a top side of each of the plate members.

In use, an inside edge of each the clamp assemblies presses against the rim of a barrel to firmly hold the barrel under the rim during the lift. The cable is removably attached to a hook on a hoist to lift the barrel. After the barrel is lowered into a desired place, the user slides and moves the clamp assemblies away from the barrel.

The cable is heavy duty and can be formed of steel to prevent breakage during use to move each barrel. The maximum overall length of the present device is 24 inches, the maximum width is 12 inches, and the maximum height is 5 inches.

Thus has been broadly outlined the more important features of the present telescopic barrel lifting attachment device so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
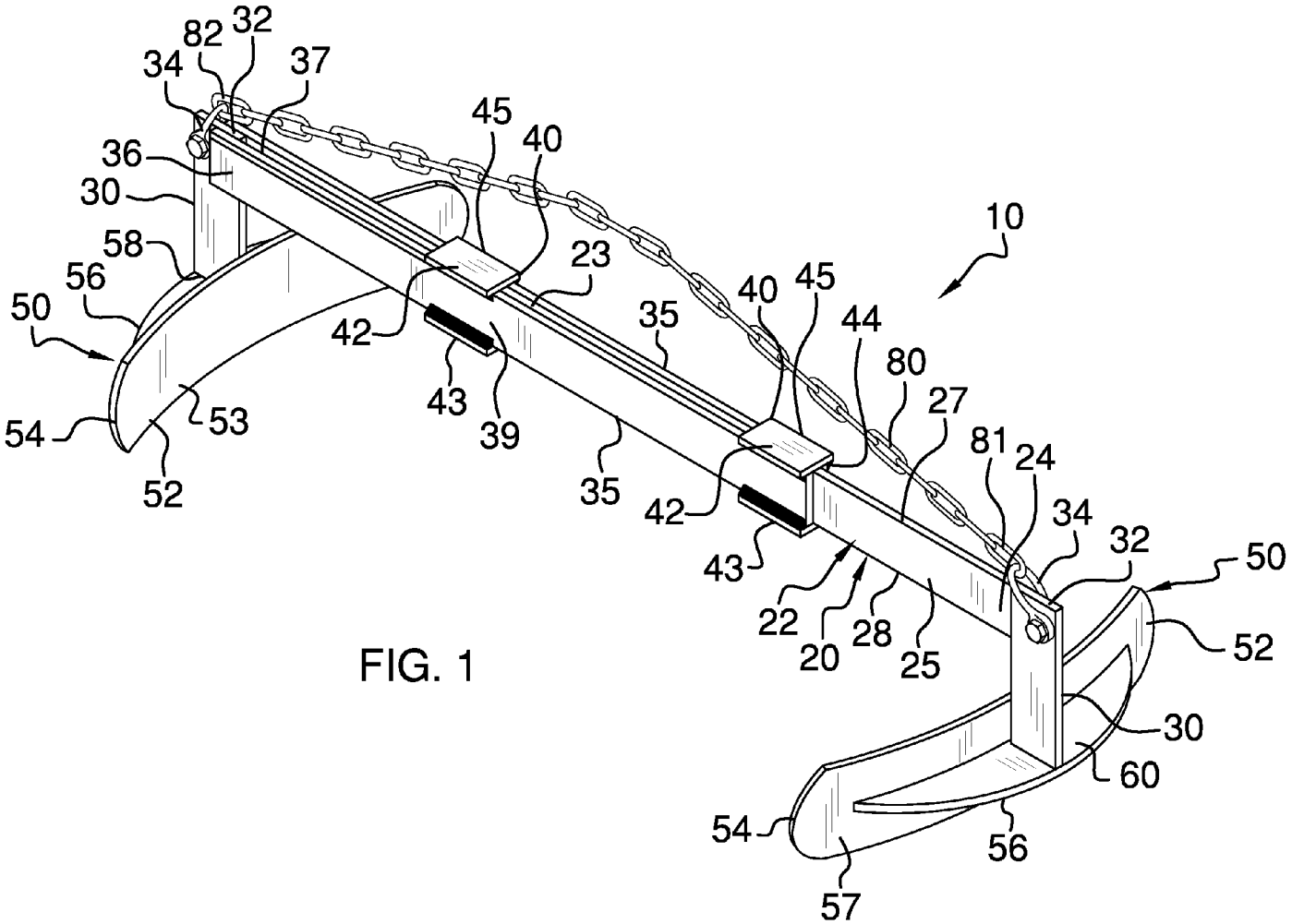
FIG. 1 is an isometric view.
Figure 2:
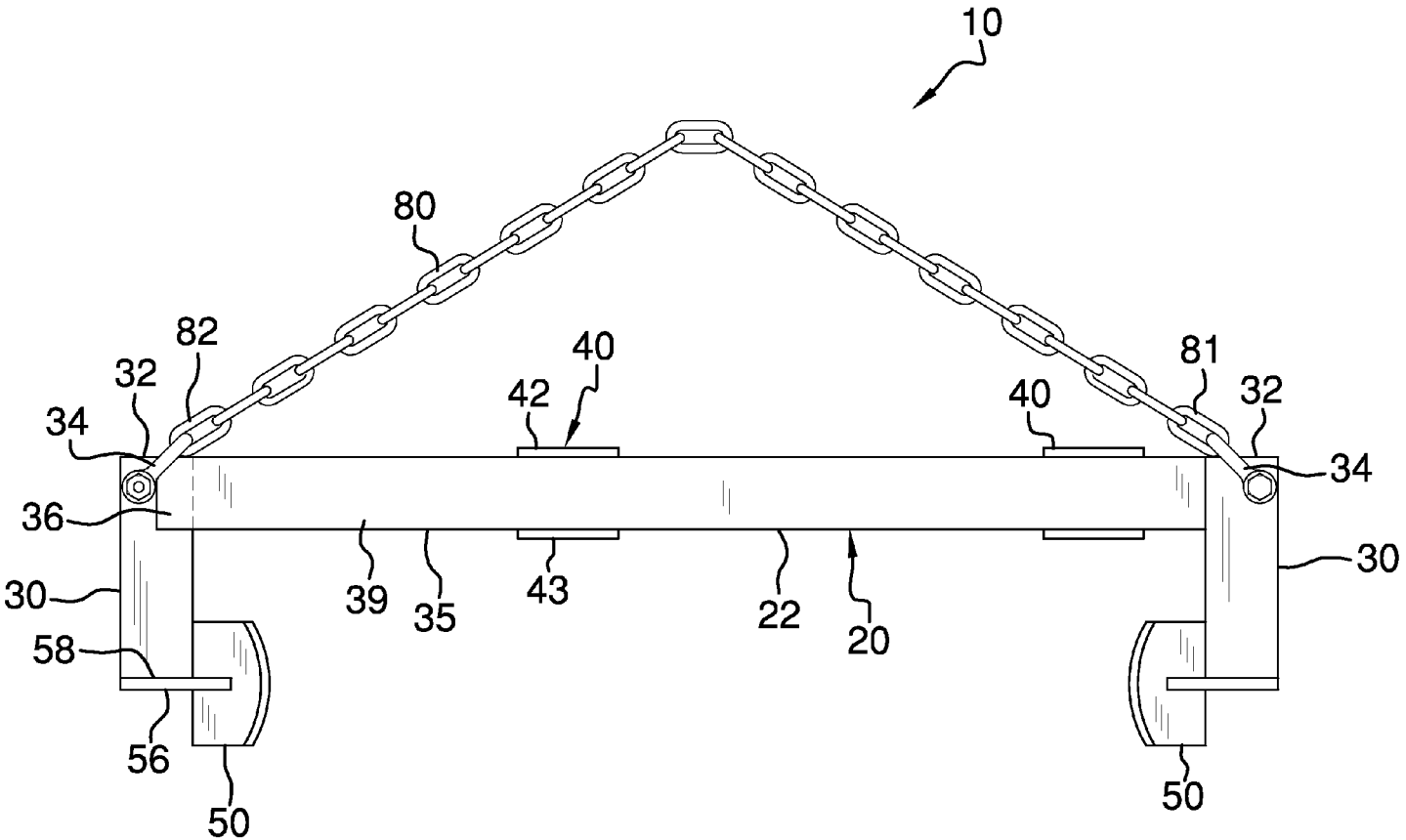
FIG. 2 is a front elevation view.
Figure 3:
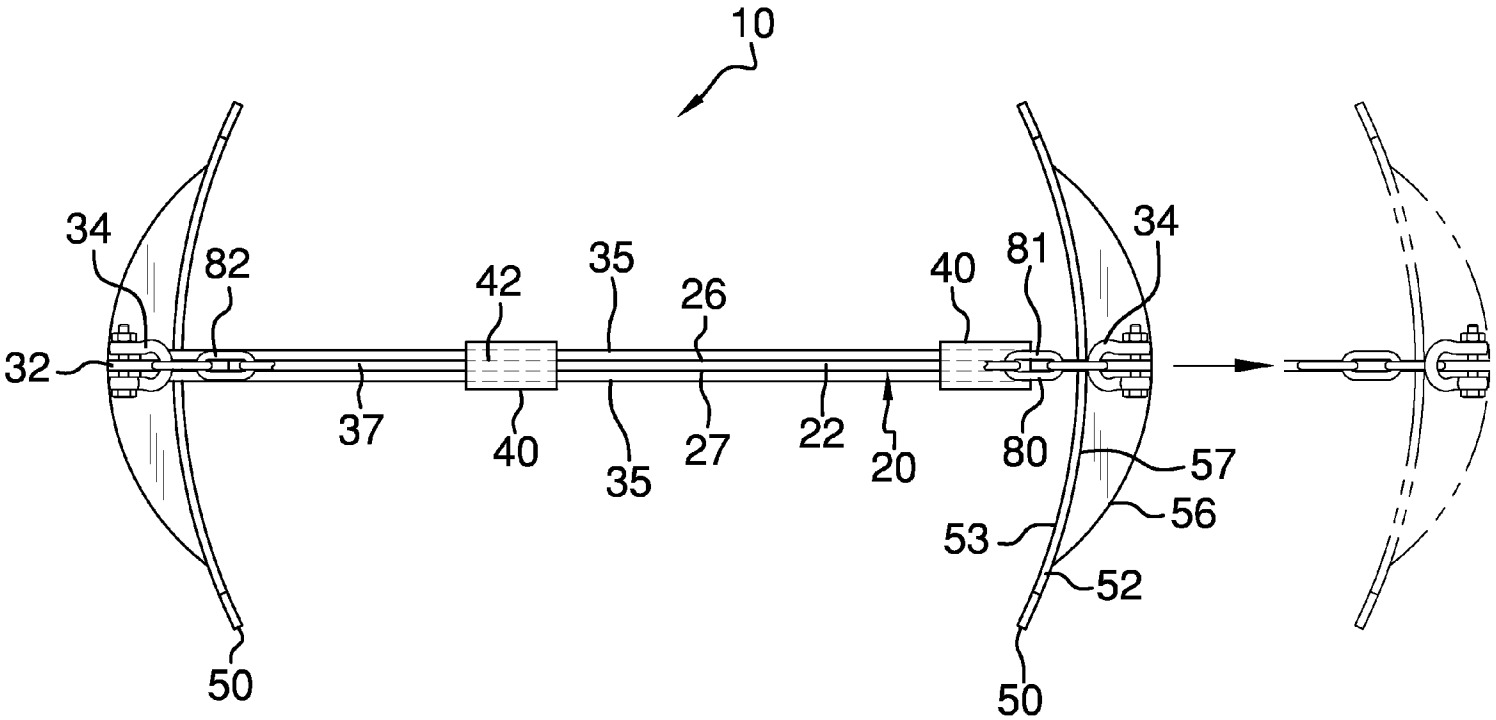
FIG. 3 is a top plan view.
Figure 4:
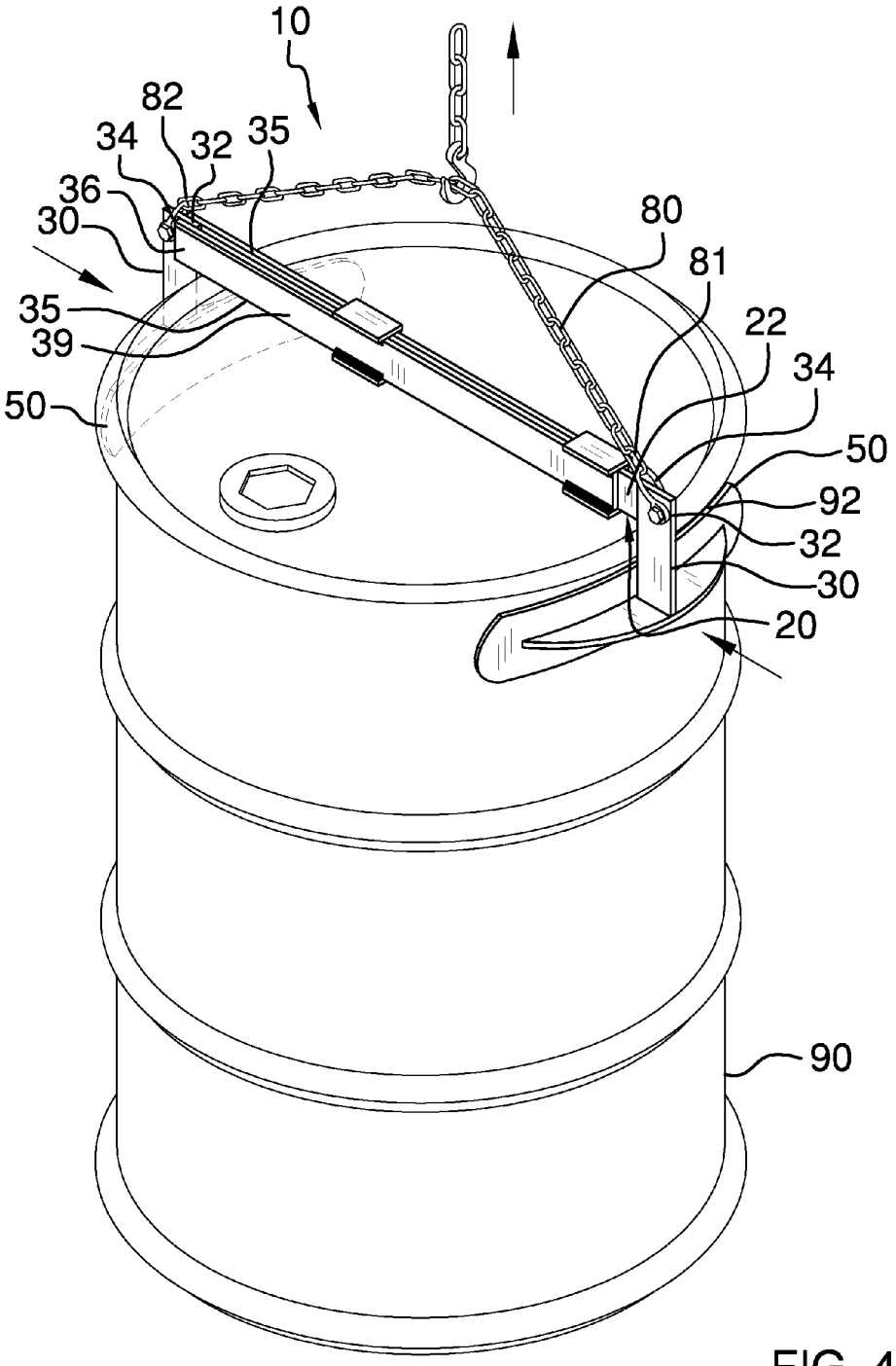
FIG. 4 is an in-use isometric view.

With reference now to the drawings, and in particular FIGS. 1 through 4 thereof, example of the instant telescopic barrel lifting attachment device employing the principles and concepts of the present telescopic barrel lifting attachment device and generally designated by the reference number 10 will be described.

Referring to FIGS. 1 through 4 a preferred embodiment of the present telescopic barrel lifting attachment device 10 is illustrated. The telescopic barrel lifting attachment device 10 is a lifting device used in conjunction with a hoist to lift a standard 55-gallon barrel and move the barrel to a desired location.

The present device 10 includes three primary components—a telescopic lifting beam 20, two clamp assemblies 50 and a cable 80. The lifting beam 20 has a substantially parallelepiped body 22 having a first end 23, a second end 24 opposite the first end 23, a front side 25, a rear side 26, a top side 27, and a bottom side 28.

A pair of spaced apart parallelepiped plate members 30 is disposed in a position perpendicular to the body 22 and in a position parallel to each other. One of the plate members 30 is permanently attached to the second end 24 of the body 22. Each plate member has an upper end 32 coextensively disposed relative to the body 22 top side 27. A shackle 34 is pivotally disposed proximal to the upper end 32 each of the plate members 30.

The cable 80 has a first external end 81 and a second external end 82. Each of the first and second external ends 81, 82 is attached to one of the shackles 34.

A pair of parallelepiped slide bars 35 slidingly engages the body 22. Each slide to bar 35 is disposed in a position parallel to one of the body 22 front side 25 and the body 22 rear side 26. Each slide bar 35 has an outer end 36 attached to the plate member 30 proximal to the cable 80 second external end 82. A channel 37 is continuously disposed between the slide bars 35.

A pair of spaced apart retainer clamps 40 is attached to an outer side 39 of each of the slide bars 35. The retainer clamps 40 assist in attaching the slide bars 35 together with the channel 37 disposed therebetween. Each retainer clamp 40 has an L-shaped top wall 42, an L-shaped bottom wall 43 opposite the top wall 42, and a side wall 44 continuously disposed between an outer edge 45 of each of the top wall 42 and the bottom wall 43. The body 22 slidingly engages the channel 37.

A clamp assembly 50 is attached to each of the plate members 30. Each clamp assembly 50 has an inner concave plate 52 having an internal wall 53. The internal wall 53 has rounded exterior ends 54, rather than pointed ends, to prevent injury to a user while handling the device 10. The internal wall 53 is configured to conform to a rim 92 of a 55-gallon barrel 90. Each clamp assembly 50 also has a lune-shaped outer concave plate 56 centrally disposed on an outer wall 57 of the inner concave plate 52. A bottom wall 58 of each plate member 30 is centrally disposed on an upper wall 60 of each outer concave plate 56. The internal wall 53 of each clamp assembly 50 inner concave plate 52 is configured to engage a rim 92 of a 55-gallon barrel 90.

The cable 80 is configured to be hooked onto and raised by a hoist. In use, the 50 clamp assemblies press inwardly toward each other and against the barrel 90 rim 92 upon the raising of the cable 80 to easily and securely raise and move the barrel 90 without any danger of the barrel 90 falling to the ground or floor. The clamp assemblies 50 separate away from each other and away from the barrel 90 rim 92 upon the lowering of the cable 80 to lower the barrel 90 into a desired place. After the barrel 90 is lowered into a desired place, the user slides and moves the clamp assemblies 50 away from the barrel 90 for re-use of the device 10.

The cable 80 is heavy duty and can be formed of steel to ensure durability and non-breakage during the lifting of the barrel 90. The maximum overall length of the present device 10 is approximately 24 inches, the maximum width is approximately 12 inches, and the maximum height is approximately 5 inches.

What is claimed is:

1. A telescopic barrel lifting attachment device comprising:

a telescopic lifting beam comprising:

a substantially parallelepiped body having a first end, a second end opposite the first end, a front side, a rear side, a top side, and a bottom side;

a pair of spaced apart parallelepiped plate members disposed in a position perpendicular to the body and parallel to each other, one of the plate members permanently attached to the body second end, each plate member having an upper end coextensively disposed relative to the body top side;

a shackle pivotally disposed proximal to the upper end of each plate member;

a cable having a first external end and a second external end, each of the first and second external ends attached to one of the shackles;

a pair of parallelepiped slide bars, each slide bar disposed in a position parallel to one of the body front side and the body rear side;

an outer end of each slide bar attached to the plate member proximal to the cable second external end;

a channel continuously disposed between the slide bars;

a pair of spaced apart retainer clamps, each retainer clamp attached to an outer side of each of the slide bars;

wherein the body slidingly engages the channel;

a pair of clamp assemblies, each clamp assembly attached to one of the plate members, each clamp assembly comprising:

an inner concave plate having an internal wall;

an outer concave plate centrally disposed on an outer wall of the inner concave plate;

a bottom wall of each plate member centrally disposed on an upper wall of each outer concave plate;

wherein the internal wall of each clamp assembly inner concave plate is configured to engage a rim of a 55-gallon barrel.

2. The telescopic barrel lifting attachment device of claim 1 wherein the cable is configured to be hooked onto and raised by a hoist;

wherein the clamp assemblies press inwardly toward each other and against the barrel rim upon the raising of the cable;

wherein the barrel rises upon the raising of the cable;

wherein the clamp assemblies separate away from each other and away from the barrel rim upon the lowering of the cable;

wherein the barrel lowers upon the lowering of the cable.

3. A telescopic barrel lifting attachment device comprising:

a telescopic lifting beam comprising:

a substantially parallelepiped body having a first end, a second end opposite the first end, a front side, a rear side, a top side, and a bottom side;

a pair of spaced apart parallelepiped plate members, one of the plate members permanently attached to the body second end, each plate member having an upper end coextensively disposed relative to the body top side;

a shackle pivotally disposed proximal to the upper end of each plate member;

a cable having a first external end and a second external end, each of the first and second external ends attached to one of the shackles;

a pair of parallelepiped slide bars, each slide bar disposed in a position parallel to one of the body front side and the body rear side;

an outer end of each slide bar attached to the plate member proximal to the cable second external end;

a channel continuously disposed between the slide bars;

a pair of spaced apart retainer clamps, each retainer clamp attached to an outer side of each of the slide bars, each retainer clamp comprising:

an L-shaped top wall;

an L-shaped bottom wall opposite the top wall;

a side wall continuously disposed between an outer edge of each of the top wall and bottom wall;

wherein the body slidingly engages the channel;

a pair of clamp assemblies, each clamp assembly attached to one of the plate members, each clamp assembly comprising:

an inner concave plate having an internal wall, the internal wall having rounded exterior ends, wherein the internal wall is configured to conform to a rim of a 55-gallon barrel;

a lune-shaped outer concave plate centrally disposed on an outer wall of the inner concave plate;

a bottom wall of each plate member centrally disposed on an upper wall of each outer concave plate;

wherein the internal wall of each clamp assembly inner concave plate is configured to engage a rim of a 55-gallon barrel.

4. The telescopic barrel lifting attachment device of claim 3 wherein the cable is configured to be hooked onto and raised by a hoist;

wherein the clamp assemblies press inwardly toward each other and against the barrel rim upon the raising of the cable;

wherein the barrel rises upon the raising of the cable;

wherein the clamp assemblies separate away from each other and away from the barrel rim upon the lowering of the cable; and wherein the barrel lowers upon the lowering of the cable.

* * * * *